US011618664B2

(12) United States Patent
Castonguay

(10) Patent No.: US 11,618,664 B2
(45) Date of Patent: Apr. 4, 2023

(54) BEVERAGE DISTRIBUTION SYSTEM

(71) Applicant: SYSTEMES MCED INC., Les Coteaux (CA)

(72) Inventor: Mathieu Castonguay, Coteau-du-lac (CA)

(73) Assignee: SYSTÈMES MCED INC., Les Coteaux (CA)

( * ) Notice: Subject to any disclaimer, the term of this patent is extended or adjusted under 35 U.S.C. 154(b) by 0 days.

(21) Appl. No.: 17/358,128

(22) Filed: Jun. 25, 2021

(65) Prior Publication Data

US 2022/0411251 A1 Dec. 29, 2022

(51) Int. Cl.

| | |
|---|---|
| ***B67D 1/12*** | (2006.01) |
| ***B67D 1/08*** | (2006.01) |
| ***B67D 99/00*** | (2010.01) |
| ***B67D 1/00*** | (2006.01) |

(52) U.S. Cl.

CPC ..... *B67D 1/12* (2013.01); *B67D 1/0878* (2013.01); *B67D 99/00* (2013.01); *B67D 2001/0093* (2013.01); *B67D 2210/00141* (2013.01)

(58) Field of Classification Search

CPC ..... B67D 1/12; B67D 1/0878; B67D 99/00; B67D 2001/0093; B67D 2210/00141

See application file for complete search history.

(56) References Cited

U.S. PATENT DOCUMENTS

| | | | | |
|---|---|---|---|---|
| 3,380,629 | A * | 4/1968 | Kontra | B67D 1/1466 222/26 |
| 4,226,343 | A * | 10/1980 | Fling | B67D 1/1466 251/63.4 |
| 5,363,989 | A * | 11/1994 | Zeamer | B67D 1/1234 251/30.01 |
| 9,630,827 | B2 * | 4/2017 | Bencista' Falorni | B67D 1/1272 |
| 11,286,145 | B2 * | 3/2022 | Newton | B67D 1/0085 |
| 11,407,629 | B1 * | 8/2022 | Siegel | B67D 1/0878 |
| 2021/0362993 | A1 * | 11/2021 | Shafir | G06Q 30/06 |
| 2022/0017354 | A1 * | 1/2022 | Cahill | B67D 1/1405 |

* cited by examiner

*Primary Examiner* — Jeremy Carroll

(74) *Attorney, Agent, or Firm* — Norton Rose Fulbright Canada LLP

(57) ABSTRACT

A beverage dispensing system, has: a reservoir; a line connected to the reservoir; a tap connected to the line; a first valve connected to the line downstream of the reservoir, the first valve having a first open configuration and a first closed configuration; and a second valve connected to the line, the second valve having a second open configuration and a second closed configuration, the second valve being in the second closed configuration when the first valve is in the first closed configuration, when in the second closed configuration, the second valve blocking fluid communication between the tap outlet and the first valve, the second valve being in the second open configuration when the first valve is in the first open configuration to connect the reservoir to the tap outlet through the first valve and the second valve.

20 Claims, 8 Drawing Sheets

BEVERAGE DISTRIBUTION SYSTEM

TECHNICAL FIELD

This disclosure generally relates to the field of beverage dispensing systems and, more particularly, to the field of draft beer dispensers.

BACKGROUND OF THE ART

A typical draft beer dispensing system includes a reservoir containing the beer, a tap, and a line that connects the beer to the tap. A user may pour a beer by actuating a handle on the tap. However, this may require the user touching the handle. There is now a need for providing a touchless beer dispensing system where users can pour themselves a beer or other beverages without having to touch the dispensing system to limit the spread of pathogens.

SUMMARY

In one aspect, there is provided a beverage dispensing system, comprising: a reservoir containing a beverage; a line connected to the reservoir; a tap connected to the line for pouring the beverage; a first valve connected to the line downstream of the reservoir relative to a flow of the beverage in the line, the first valve having a first open configuration and a first closed configuration; and a second valve connected to the line downstream of the first valve and at or proximate a tap outlet of the tap, the second valve having a second open configuration and a second closed configuration, the second valve being in the second closed configuration when the first valve is in the first closed configuration, when in the second closed configuration, the second valve blocking fluid communication between the tap outlet and the first valve such that a portion of the line between the first valve and the second valve is isolated from the tap outlet, the second valve being in the second open configuration when the first valve is in the first open configuration to connect the reservoir to the tap outlet through the first valve and the second valve.

The beverage dispensing system may include any of the following features, in any combinations.

In some embodiments, the second valve is a non-actuated valve moving from the second closed configuration to the second open configuration following a pressure differential across the second valve greater than a pressure threshold.

In some embodiments, the pressure threshold corresponds to a beverage pressure inside the line upstream of the first valve.

In some embodiments, the second valve includes: a valve housing defining a passage for the beverage, a valve member movable relative to the valve housing from a first position in which the valve member obstructs the passage to a second position in which the valve member is offset from the passage, and a biasing member biasing the valve member in the first position.

In some embodiments, the biasing member is a magnet secured to one of the valve member and the valve housing and magnetically attracting the other of the valve member and the valve housing to magnetically force the valve member in the first position.

In some embodiments, a force of the magnet is selected such that the valve member moves from the first position the second position when the valve member is subjected to a beverage pressure when the first valve is in the first open configuration.

In some embodiments, the valve housing includes a main body and a valve seat secured to the main body, the valve member in abutment against the valve seat in the first position, the valve seat being the magnet.

In some embodiments, the valve member is a ball movable within the valve housing.

In some embodiments, the valve member is a gate pivotably connected to the valve housing and pivotable between the first position and the second position, the biasing member being a spring engaged to the gate.

In some embodiments, the first valve is an actuated valve engaged by an actuator.

In some embodiments, the actuator is a solenoid.

In some embodiments, a controller has a processing unit and a computer-readable medium operatively connected to the processing unit and having instructions stored thereon executable by the processing unit for: receiving a signal indicative of a beverage request from a user; and opening the first valve by actuating the actuator thereby exposing the second valve to a beverage pressure being above a retention pressure of the second valve.

In some embodiments, the receiving of the signal includes receiving a signal from a smart phone of a user.

In some embodiments, the receiving of the signal from the smart phone includes receiving the signal from the smart phone via a cloud.

In another aspect, there is provided a passive valve for a beverage dispensing system, comprising: a housing defining a passage for flowing the beverage, the housing defining a valve seat; and a valve member movable within the housing from a first position in which the valve member is sealingly engaged to the valve seat to a second position in which the member is offset from the valve seat to allow fluid communication from an inlet to an outlet of the passive valve, wherein one of the housing and the valve member includes a magnet and the other of the valve seat and the valve member includes a magnetically-attractable material.

In yet another aspect, there is provided a method for dispensing a beverage from a reservoir to a tap, comprising: receiving a signal indicative of a beverage request from a user; opening a first valve to allow the beverage to flow from the reservoir through the first valve; flowing the beverage from the first valve to a second valve downstream of the first valve; and overcoming a retention force of the second valve with a beverage pressure to allow the beverage to flow from the reservoir to the tap through the first valve and through the second valve.

The method may include any of the following features, in any combinations.

In some embodiments, the receiving of the signal includes receiving a signal from a smart phone of a user.

In some embodiments, the opening of the first valve includes powering an actuator operatively connected to the first valve.

In some embodiments, the overcoming the retention force includes overcoming a magnetic force between a valve member of the second vale and a valve seat of the second valve.

In some embodiments, the overcoming of the magnetic force includes moving a ball away from the valve seat and flowing the beverage around the ball from an inlet to an outlet of the second valve.

Many further features and combinations thereof concerning the present improvements will appear to those skilled in the art following a reading of the instant disclosure.

DETAILED DESCRIPTION

Figure 1:
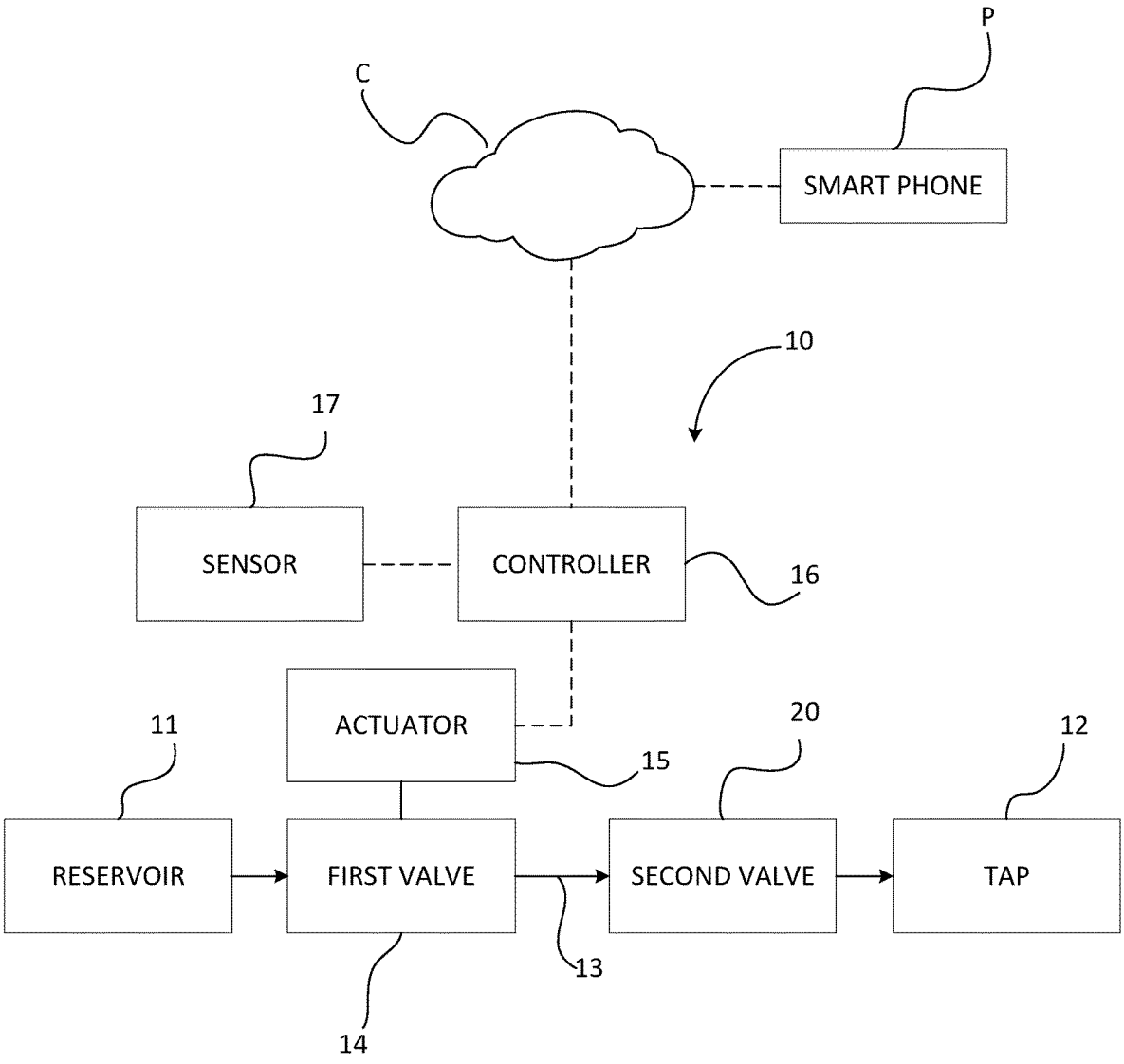
FIG. 1 is a schematic view of an exemplary beverage dispensing system.

Referring to FIG. 1, a beverage dispensing system is shown at 10. The system 10 is used for delivering a beverage, such as a beer, from a reservoir 11 to a tap 12. The system 10 includes a line 13 that fluidly connects the reservoir 11 to the tap 12. The system 10 includes first valve 14 connected to the line 13 downstream of the reservoir 11 and upstream of the tap 12. Herein, the expressions "upstream" and "downstream" are in reference to a flow of the beverage in the line 13 from the reservoir 11 towards the tap 12. The first valve 14 has a first open configuration and a first closed configuration. The first valve 14 blocks the beverage from flowing from the reservoir 11 to the tap 12 through the first valve 14 in the first closed configuration and allows the beverage to flow through the first valve 14 in the first open configuration.

Nowadays, touchless or contact less solutions are preferred to limit spread of pathogens and viruses. In the embodiment shown, the first valve 14 is an actuated valve and is engaged by an actuator 15. The actuator 15 may be, for instance, a solenoid or any other suitable of actuators, such as a pneumatic actuator, a hydraulic actuator, and so on. The first valve 14 may have a movable member, such as a piston or a ball, that is engaged by the actuator 15. Powering the actuator 15 may move the movable member relative a valve housing to selectively allow or block fluid communication through the first valve 14.

In the present embodiment, the actuator 15 is operatively connected to a controller 16. The controller 16 may be operatively connected to a sensor 17 that may send a signal to the controller 16. The signal may be indicative of a presence of a glass underneath the tap 12 as a safety feature to prevent the pouring of the beverage when no glass is present. For instance, the sensor 17 may be proximity sensor detecting the presence of the glass or other recipient underneath the tap 12. The sensor 17 may be a weight sensor detecting the presence of the glass. This weight sensor may also determine when the glass is full.

In the embodiment shown, the user may have an application installed on a smart phone P. The smart phone P may be in wireless communication with a cloud C. The cloud C may be wirelessly connected to the controller 16. Hence, the user may send a beverage request to the controller 16 via the smart phone P and the cloud C to trigger the pouring of the beverage. Consequently, the user may pour himself or herself the beverage without having to touch a handle or lever of the tap 12. The user may simply dispose his or her glass underneath the tap 12 and trigger the pouring of the beverage with his or her smart phone P. The controller 16 may, upon reception of this signal from the cloud C, triggers the opening of the first valve 14 from the first closed configuration to the first opened configuration by actuating the actuator 15.

In some other embodiments, the smart phone may be directly connected to the controller 16. This may be done via any suitable communication link such as internet, WiFi, Bluetooth, GSM, Ethernet, and so on. The user may connect his or her smartphone to the controller 16 to trigger the pouring of the beverage. The user may, in some cases, select a beverage with his or her smart phone.

In some other embodiments, the triggering of the pouring of the beverage, and the triggering of the opening of the first valve 14, may be caused by the reception of a signal from a sensor, such as a proximity or weight sensor, by the controller 16. In this case, the user may not need to use his or her smart phone. In some other embodiments, an RFID tag, a chip, and so on may be used to trigger the opening of the first valve 14.

In order to limit modifications of the tap 12, it may be desired to locate this first valve 14 close to the reservoir 11 where it cannot be seen by the user. However, doing so may result in a long portion of the line 13 being opened to ambient air via the tap 12. This portion of the line 13 may further become depressurized. Hence, when a next user pours the beverage, the content of this portion of the line 13 will now be flat in the case of a carbonated beverage (e.g., beer, soft drinks, etc). This is undesirable.

Still referring to FIG. 1, in the embodiment shown, the system 10 includes a second valve 20, which may be referred to as a slave, passive, or non-actuated valve. The second valve 20 is connected to the line 13 downstream of the first valve 14. The second valve 20 may be located proximate the tap 12 or at the tap 12. In some cases, the second valve 20 is integrated in the tap 12. The second valve 20 has a second open configuration and a second closed configuration. The second valve 20 is in the second closed configuration when the first valve 14 is in the first closed configuration. When in the second closed configuration, the second valve 20 blocks fluid communication between an outlet of the tap 12 and the first valve 14 such that a portion of the line 13 between the first valve 14 and the second valve 20 is isolated from the outlet of the tap 12. The second valve 20 is in the second open configuration when the first valve 14 is in the first open configuration to connect the reservoir 11 to the tap 12 through the first valve 14 and the second valve 20.

The second valve 20 therefore follows the first valve 14, which may be considered a master valve. Hence, when the first valve 14 is switched from the first closed configuration to the first open configuration, the second valve 20 becomes exposed to a pressure of the reservoir 11. Hence, at this point, a pressure differential across the second valve 20, which may correspond to a difference between a pressure in the reservoir 11 and an ambient, or atmospheric, pressure outside the line 13, becomes greater than a retention pressure of the second valve 20. At which point, the second valve 20 moves, because of this pressure differential, from the second closed configuration to the second open configuration.

Figure 2A:
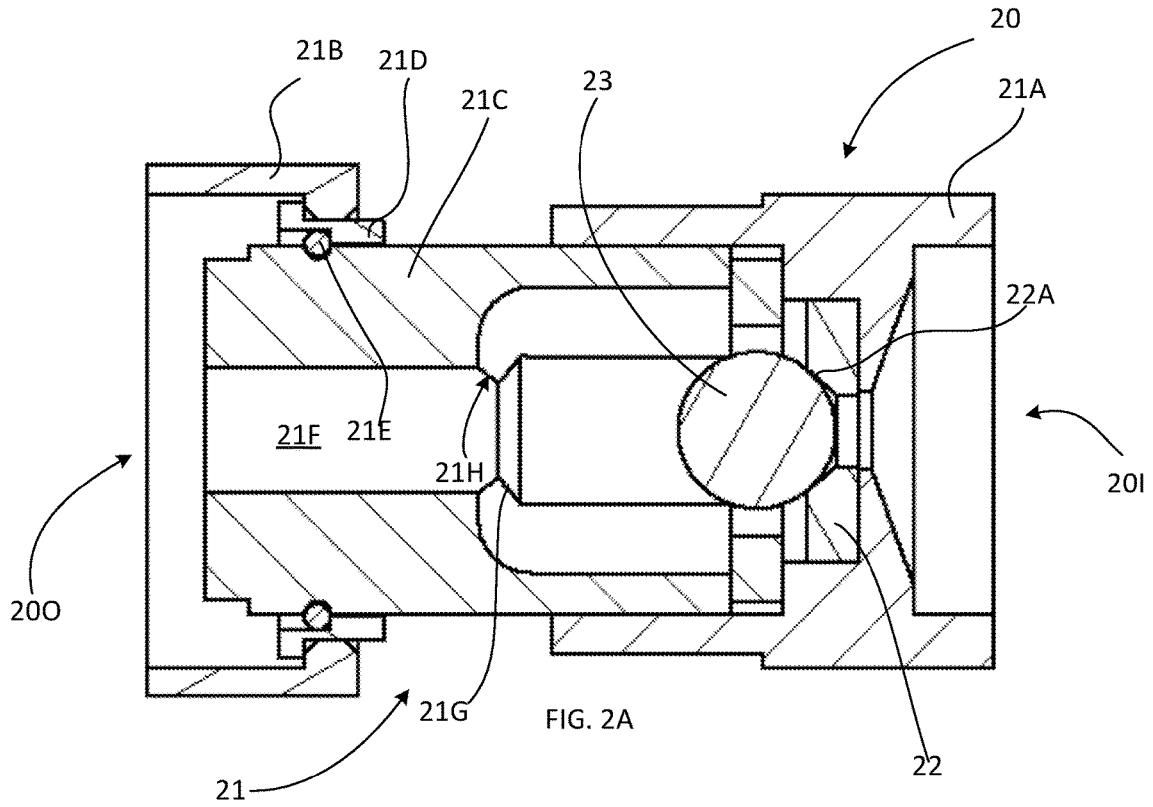
FIG. 2A is a cross-sectional view of a valve in accordance with one embodiment, the valve illustrated in a closed configuration.
Figure 2B:
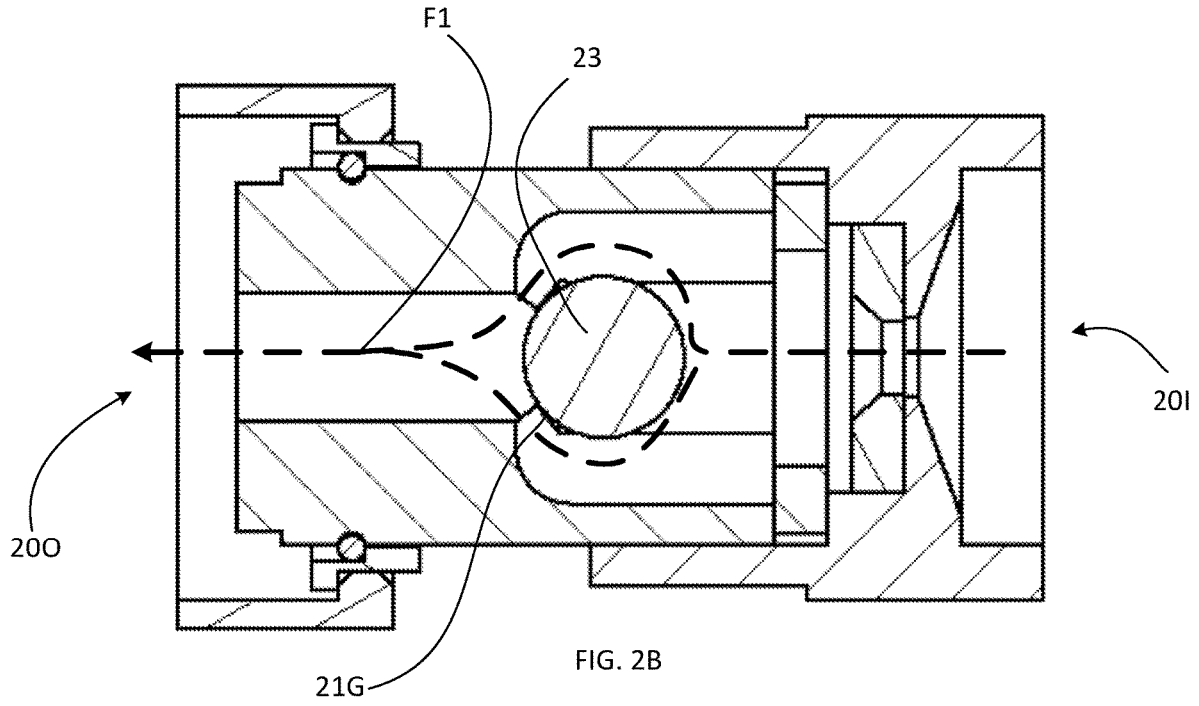
FIG. 2B is a cross-sectional view of the valve of FIG. 2A shown in an open configuration.

Referring now to FIGS. 2A and 2B, the second valve 20 is shown in greater detail. The second valve 20 has an inlet 20I and an outlet 20O. The second valve 20 has a housing 21 including a first coupler 21A defining the inlet 20I and a second coupler 21B defining the outlet 20O. The first coupler 21A and the second coupler 21B may define thread to threadingly engage parts of the tap 12. In the present case, the first coupler 21A and the second coupler 21B are separate parts each connected to a respective end of a central body 21C of the housing 21. However, in an alternate embodiment, the housing 21 may be a monolithic part. In the present embodiment, the second coupler 21B is secured to the central body 21C via an annular ring 21D, which may allow rotation of the second coupler 21B relative to the central body 21C for fastening the second valve 20 to the line 13 or to a corresponding coupler on the tap 12. A sealing member 21E is disposed radially between the annular ring 21D and the central body 21C to provide a sealing engagement therebetween. The housing 21 further defines a passage 21F via which the beverage may flow through the second valve 20 from the inlet 20I to the outlet 20O.

The second valve 20 further includes a valve seat 22 disposed within the housing 21. The valve seat 22 may be an annular piece. In the present case, the valve seat 22 is secured to the first coupler 21A of the housing 21, but may alternatively be secured to the central body 21C or to the second coupler 21B without departing from the scope of the present disclosure. The valve seat 22 defines an abutment face 22A. In the present embodiment, the abutment face 22A has a frustoconical shape, but other shapes are contemplated depending of a shape of movable member of the valve.

The second valve 20 has a valve member 23, also referred to as a movable member. The valve member 23 is located inside the passage 21F of the housing 21. The valve member 23 is movable from a first position depicted in FIG. 2A to a second position depicted in FIG. 2B. The first position of the valve member 23 corresponds to the second closed configuration of the second valve 20. The second position of the valve member 23 corresponds to the second open configuration of the second valve 20. In the first position shown in FIG. 2A, the valve member 23, which is a ball in the present embodiment, is in abutment against the abutment face 22A of the valve seat 22 such that a sealing engagement is provided between the valve member 23 and the valve seat 22 to prevent fluid communication between the inlet 20I and the outlet 20O of the second valve 20.

In the embodiment shown, the valve member 23 is made of a magnetically-attractable material, such as a ferromagnetic material and the valve seat 22 may be a magnet or may include a magnet. In some other embodiments, the valve member 23 is a magnet and the valve seat is made of a magnetically-attractable material. Both of the valve member 23 and the valve seat 22 may be magnets as long as the poles are aligned such that they are attracted towards one another.

In the embodiment shown, a magnetic force generated between the valve member 23 and the valve seat 22 when they are in contact against one another is such that when the first valve 14 is switched from its first closed configuration to its first open configuration the pressure of the beverage in the line 13 is sufficient to move the valve member 23 away from the valve seat 22 to allow the passage of the beverage through the second valve 20. In other words, the magnetic force, which herein corresponds to a retention force of the second valve 20, is less than a force generated by the pressure of the beverage when the first valve 14 is in the first open configuration. Therefore, the second valve 20 may move from its second closed configuration to its second open configuration solely by the pressure in the line 13 when the first valve 14 is opened. The second valve 20 may therefore need no actuation or control and follows operation of the first valve 14. When the first valve 14 is switched to the first closed configuration, the pressure in the line 13 decreases such that the magnet is able to move the valve member 23 toward the valve seat 22 to close the passage 21F between the inlet 20I and the outlet 20O of the second valve 20.

Referring more particularly to FIG. 2B, the passage 21F defines a decrease in its flow circulating area between the inlet 20I and the outlet 20O of the second valve 20. At this location of the decrease in the flow circulating area, the housing 21 defines a shoulder 21G. In the embodiment shown, this shoulder 21G has a frustoconical shape such that the valve member 23, which is a ball in this embodiment, remains centered in the housing 21 when the beverage flows from the inlet 20I to the outlet 20O. The shoulder 21G may not extend annularly all around the passage 21F to allow the beverage to flow around the valve member 23. Hence, the shoulder 21G may include a plurality of shoulder sections distributed around a central axis of the housing 21 and interspaced from one another by apertures 21H (FIG. 2A) via which the beverage may flow around the valve member 23 as shown with the arrow F1 in FIG. 2B.

The disclosed second valve 20 may be easily retrofitted an any beverage system, such as draught beer system. It may provide a minimal impact on a visual aspect of the tap 12 for the user, it may be designed to completely replace a standard faucet/tap or it may be an add-on to an existing faucet, it may be strictly mechanical in that it may not need any source of energy, and it may minimize or avoid dripping at the tap 12.

Figure 3A:
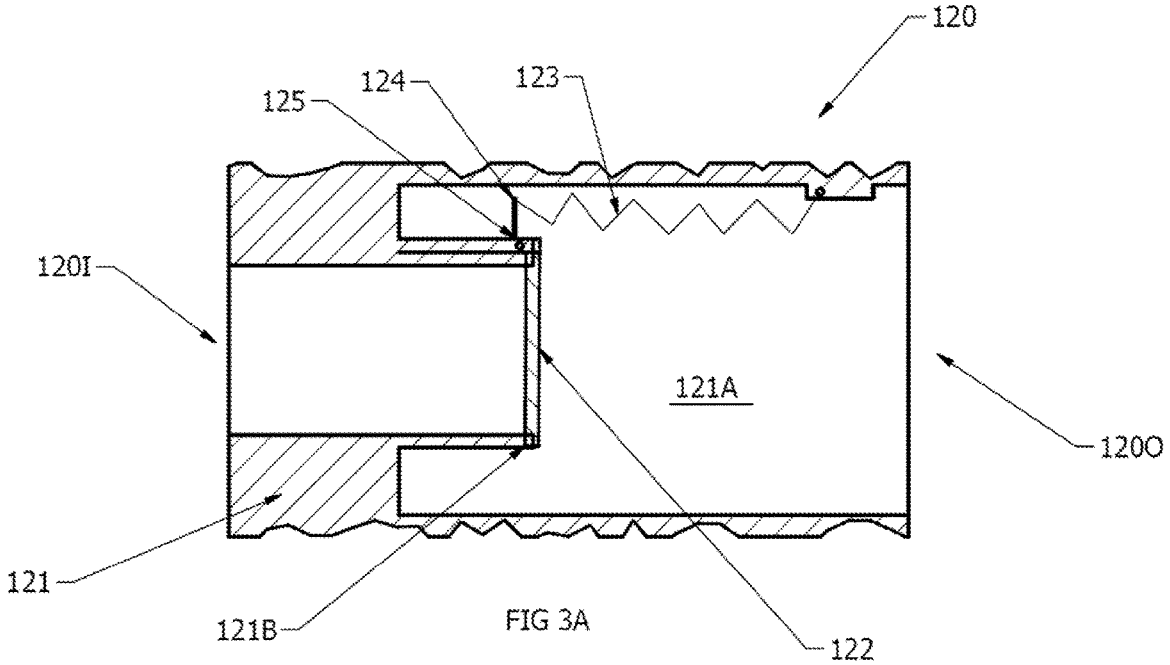
FIG. 3A is a cross-sectional view of a valve in accordance with another embodiment, the valve illustrated in a closed configuration.
Figure 3B:
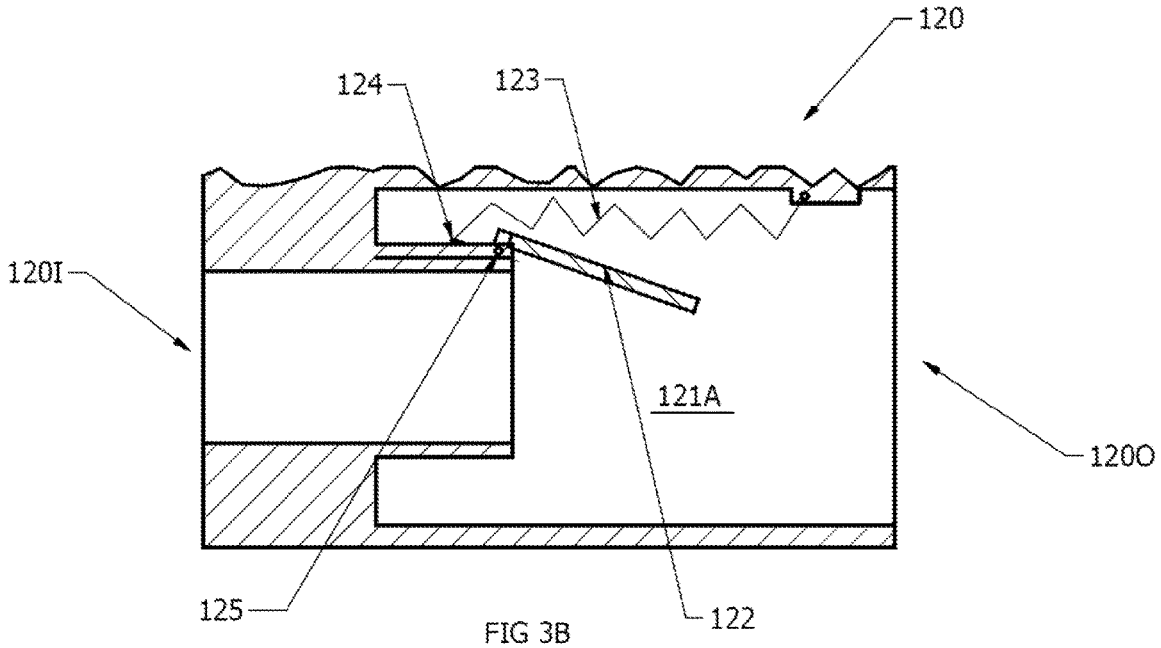
FIG. 3B is a cross-sectional view of the valve of FIG. 3A shown in an open configuration.

Referring now to FIGS. 3A and 3B, another embodiment of the second valve is shown at 120. The second valve 120 includes a housing 121 defining a passage 121A via which the beverage may flow from an inlet 120I to an outlet 120O of the second valve 120. The second valve 120 includes a valve member 122, which is depicted as a gate, that is pivotably connected to the housing 121. The valve member 122 is pivotable from a first position shown in FIG. 3A to a second position shown in FIG. 3B. The first position of the valve member 122 corresponds to the second closed configuration of the second valve 120. The second position of the valve member 122 corresponds to the second open configuration of the second valve 120. In the first position depicted in FIG. 3A, the valve member 122 abuts a seat 121B defined by the housing 121. The seat 121B may be annular. The valve member 122 may include more than one gate.

In the embodiment shown, a biasing member 123 is connected to a lever 124. The lever 124 and the valve member 122 are connected to one another and located on opposite sides of a pivot point 125 about which the valve member 122 pivots between the first and second positions. In some other embodiments, the biasing member 123 may be connected directly to the valve member 122. The biasing member 123 may be a spring or any other suitable biasing member, such as an elastic and so on. The biasing member 123 is connected at one end to the lever 124 and at another end to the housing 121 or other fixed structure. The biasing member 123 exerts a force on the lever 124 that forces the lever 124 and the valve member 122 to rotate clockwise about direction D1 to bias the valve member 122 against the seat 121B of the housing 121.

A force of the biasing member 123 is calibrated as a function of a length of the lever 124 and of a distance between a location where the biasing member 123 is attached on the lever 124 and the pivot point 125. Also, the force of the biasing member 123 is selected such that the pressure in the line 13 when the first valve 14 is in the first open configuration is sufficient to displace the valve member 122 away from the seat 121B to allow the beverage to flow from the inlet 120I to the outlet 120O through the second valve 120. When the first valve 14 is switched to the first closed configuration, the pressure in the line 13 decreases such that the biasing member 123 is able to move the valve member 122 toward the seat 121B to close the passage 121A between the inlet 120I and the outlet 120O of the second valve 120.

It will be appreciated that, in another embodiment, the biasing member 123 may be replaced by a magnet. That is, one of the housing 121 and the valve member 122 may include a magnet while the other may include a magnetically-attractable material. When the first valve 14 is opened, the pressure of the beverage may be sufficient to overcome the magnetic force to pivot the valve member 122 away from the seat 121B. And, when the first valve 14 is closed, the magnetic force may be sufficient to move the valve member 122 back toward the position depicted in FIG. 3A.

In some other embodiments, the second valve may include one or more gate(s) that are hingedly connected to a housing by living hinge. Following exposure to a pressure above a pressure threshold, the one or more gate(s) may pivot, via flexion of this living hinge(s), from a first position in which they obstruct a flow passage to a second position in which the flow passage is opened. The pivoting of the one and more gate may be achieved by a flexion of the living hinge(s) that connect the one or more gate(s) to the housing.

Figure 4:
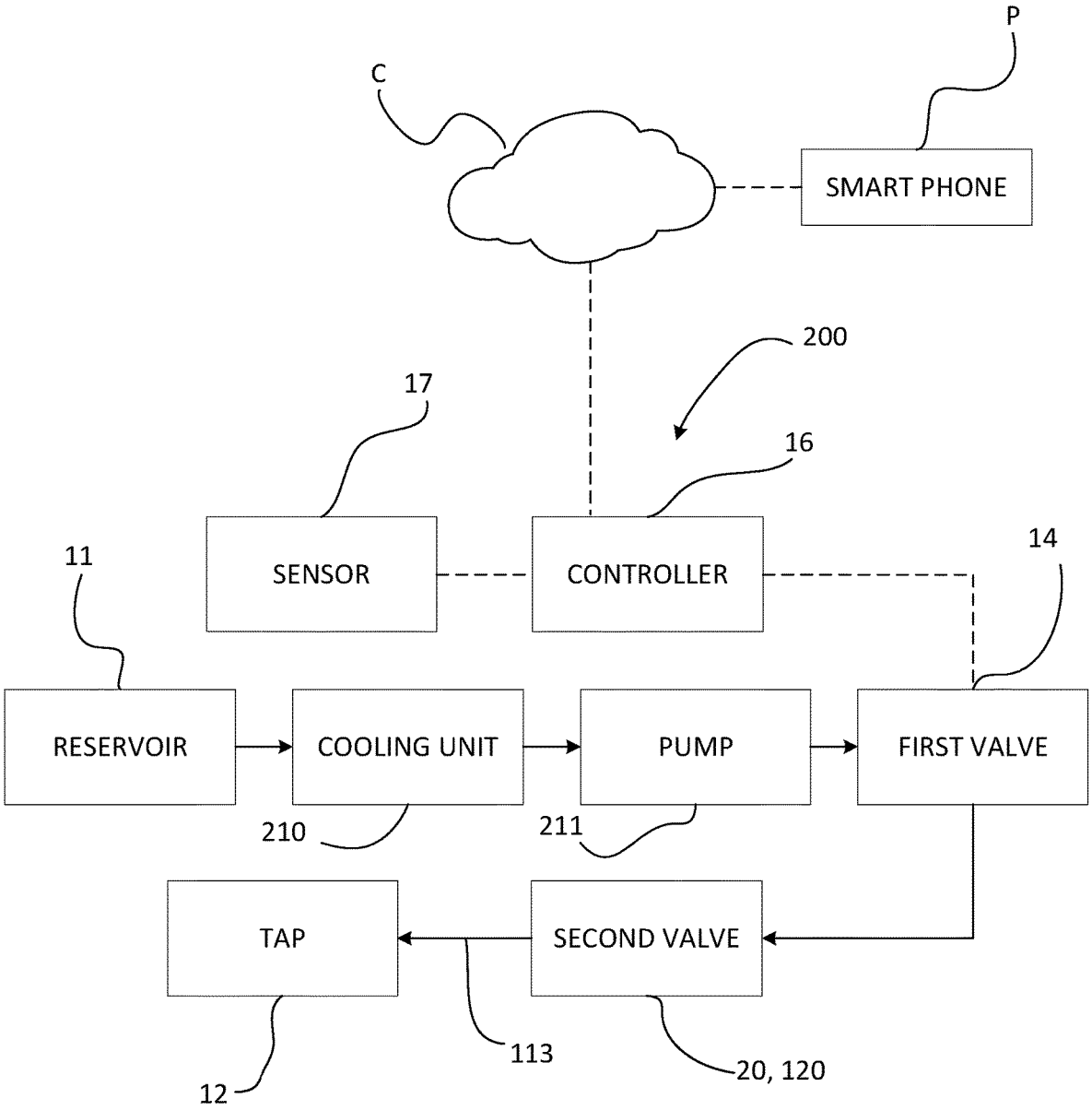
FIG. 4 is a schematic view of another exemplary beverage dispensing system.

Referring now to FIG. 4, another embodiment of beverage dispensing system is shown at 200. For the sake of conciseness, only elements that differ from the beverage dispensing system of FIG. 1 are described herein below.

In the embodiment shown, the line 113 that connects the reservoir 11 to the tap 12 may be long, which may result in unacceptable pressure drops through the line 113 and an inadequate temperature of the beverage at the tap 12. In the embodiment shown, the beverage dispensing system 200 includes a cooling unit 210 used for cooling the beverage and a pump 211 for driving a flow of the beverage in the line 113. Herein, the cooling unit 210 is disposed downstream of the reservoir 11 and upstream of the pump 211, but other configurations are contemplated.

Figure 5:
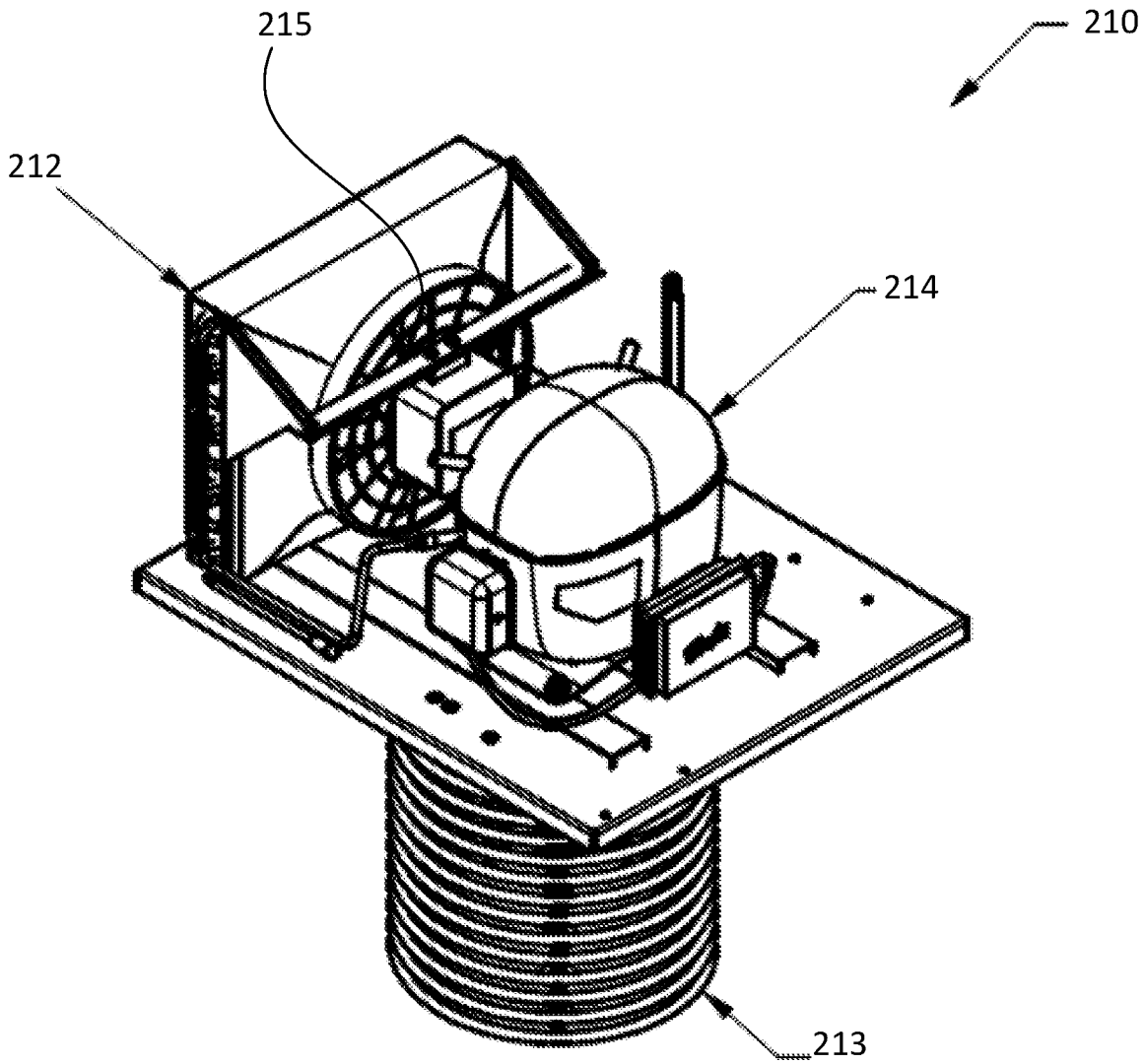
FIG. 5 is a three dimensional view of a cooling unit in accordance with one embodiment that may be used with the beverage dispensing system of FIG. 4.

Referring more particularly to FIG. 5, the cooling unit 210 is described in greater detail. The cooling unit 210 may be an air-cooled cooling unit in that it may transfer heat from the beverage to air of an environment surrounding the cooling unit 210. The cooling unit 210 may therefore be in heat exchange relationship with the beverage in the line 113.

The cooling unit 210 includes a condenser 212, an evaporator 213, and a compressor 214. An electric motor may be drivingly engaged to the compressor 214. The cooling unit 210 may include a coolant circuit that flows a liquid refrigerant such as R134a. Any suitable refrigerant known in the art may be used. The evaporator 213 corresponds to a portion of the refrigerant conduit. The condenser 212 is a heat exchanger having at least one first conduit fluidly connected to the refrigerant conduit and at least one second conduit in heat exchange relationship with the at least one first conduit and fluidly connected to air of an environment outside the refrigerant conduit. A fan 215 may be used to draw an airflow within the at least one second conduit of the condenser 212.

A temperature and pressure of the liquid refrigerant increases via its compression in the compressor 214. After exiting the compressor 214, the liquid refrigerant is routed into the condenser 212, where it transfers a portion of its heat to air circulating in the at least one second conduit of the heat exchanger. In the embodiment shown, the liquid refrigerant then goes through a regulator (e.g., expansion valve, capillary tubes, etc) before being directed through the evaporator 213 where the liquid refrigerant absorbs heat from the beverage and changes phase from liquid to gas. Therefore, the temperature of the beverage decreases via its contact with the evaporator 213. As the liquid refrigerant that exits the evaporator 213 in a gas phase, it needs to be recompressed by the compressor 214 to be reverted back to a liquid phase before being rerouted into the condenser 212. This cycle is repeated.

In some embodiments, the evaporator 213 may be located inside the reservoir 11 to cool the beverage directly in the reservoir 11. In some other embodiments, the evaporator 213 may be located in a secondary reservoir connected to the line 113 and located downstream of the reservoir 11 and upstream of the tap 12. The beverage may therefore flow from the reservoir 11 to the second reservoir where is cooled down by the cooling unit 210. The beverage may, after being cooled, flow towards the tap 12.

Figure 6:
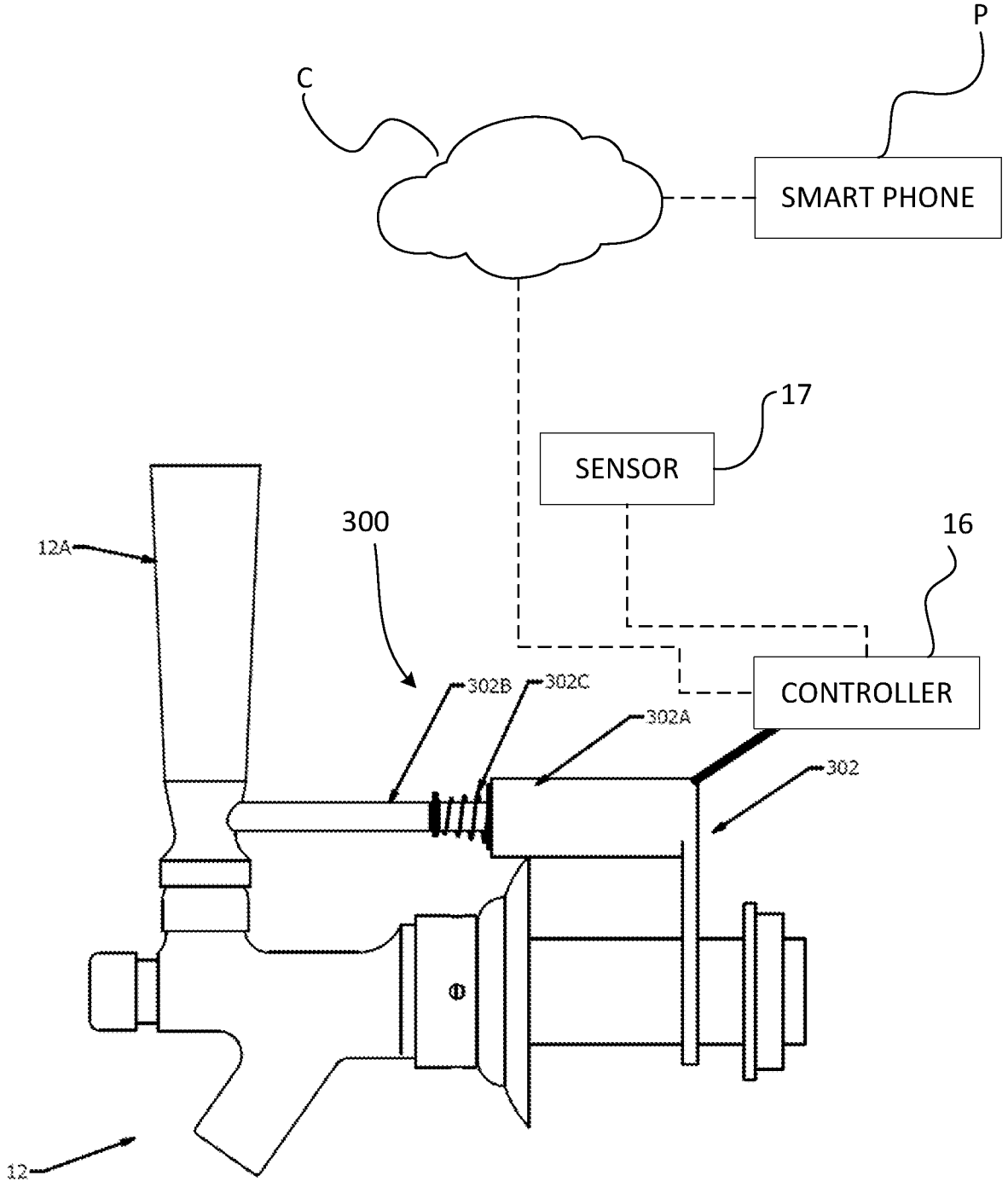
FIG. 6 is a schematic view of a tap assembly for a beverage dispensing system in accordance with another embodiment.

Referring now to FIG. 6, a tap assembly is shown at 300. The tap assembly 300 includes the tap 12 that may be already installed, for instance, in restaurants. The tap 12 may include a lever 12A engageable by a user to open the tap 12 to pour the beverage. However, to avoid the user from touching the lever 12A and to limit pathogen propagations, an actuator 302 is operatively connected to the tap 12. The actuator 302 includes an actuator housing 302A and a movable member 302B movable relative to the actuator housing 302A. The actuator 302 may be a solenoid, a pneumatic actuator, a hydraulic actuator, or any other suitable actuator. The actuator housing 302A may be secured to the tap 12 whereas the movable member 302B may be engaged to the lever 12A.

The actuator 302 may be operatively connected to the controller 16 that receives a signal from the smart phone P of the user, either directly or via the cloud C as previously described; the signal indicative of a beverage request form a user. As explained above, the sensor 17 may be used as a safety measure to ensure the presence of a glass underneath the tap 12 or may be used to trigger the pouring of the beverage without requiring the user to use his or her smart phone P as explained above. Once the signal is received, the controller 16 may power the actuator 302 to move the movable member 302B relative to the actuator housing 302A to push (or pull) on the lever 12A to trigger the pouring of the beverage via the tap 12. Once the glass is full, the controller 16 powers off the actuator 302 allowing the lever 12A to revert to its baseline position. The user may control the stopping of the pouring of the beverage with his or her smart phone P. In some cases, a sensor may send a signal to the controller 16, the signal indicative of the glass being full. This sensor may be a weight sensor underneath the glass, a proximity sensor, and so on. In some cases, a biasing member 302C is engaged to both of the actuator housing 302A and the movable member 302B and, when the actuator 302 is powered off, biases the movable member 302B and the lever 12A back toward their baseline position, which corresponds to a close configuration of the tap 12. In some other embodiments, the actuator 302 may be powered to move the movable member 302B in an opposed direction to close the tap 12. This tap assembly 300 may be fast to install, may allow savings for the customer, and may not interfere with the beverage.

Figure 7:
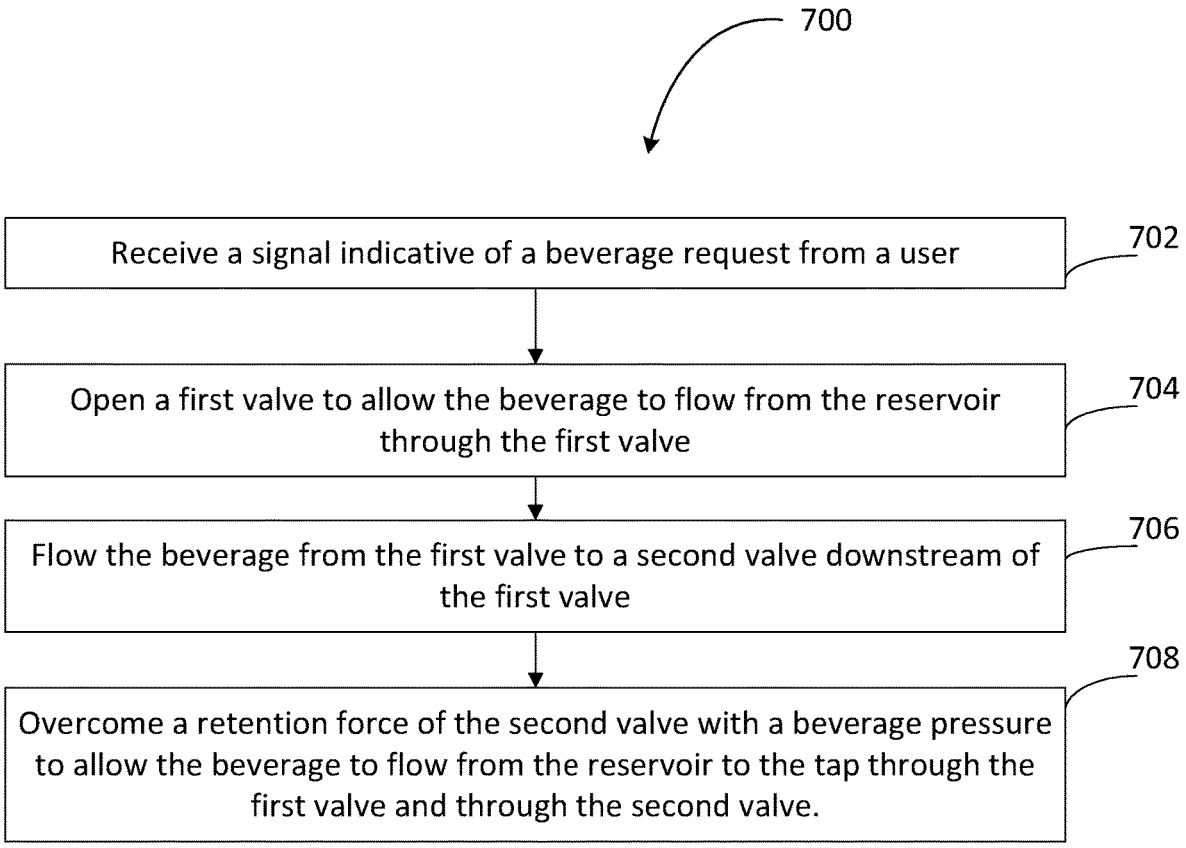
FIG. 7 is a flow chart illustrating steps of dispensing a beverage with the beverage dispensing system of FIGS. 1 and 4.

Referring now to FIG. 7, a method of dispensing a beverage is shown at 700. The method 700 includes receiving a signal at 702; the signal indicative of a beverage request from the user; opening the first valve 14 to allow the beverage to flow from the reservoir 11 through the first valve 14 at 704; flowing the beverage from the first valve 14 to the second valve 20, 120 downstream of the first valve 14 at 706; and overcoming a retention force of the second valve 20, 120 with a beverage pressure to allow the beverage to flow from the reservoir 11 to the tap 12 through the first valve 14 and through the second valve 20, 120 at 708.

In the embodiment shown, the receiving of the signal may include receiving a signal from the smart phone P of the user. The opening of the first valve 14 at 704 may include powering the actuator 15 operatively connected to the first valve 14. The overcoming the retention force at 708 may include overcoming a magnetic force between the valve member 23 of the second valve 20 and the valve seat 22. The overcoming of the magnetic force may include moving a ball away from the valve seat 22 and flowing the beverage around the ball from the inlet 20I to the outlet 200 of the second valve 20.

In some embodiments, the system may receive a system from a sensor indicative of a presence of a glass and trigger the opening of the first valve upon the reception of the signal from the sensor. This sensor may be a proximity sensor.

Figure 8:
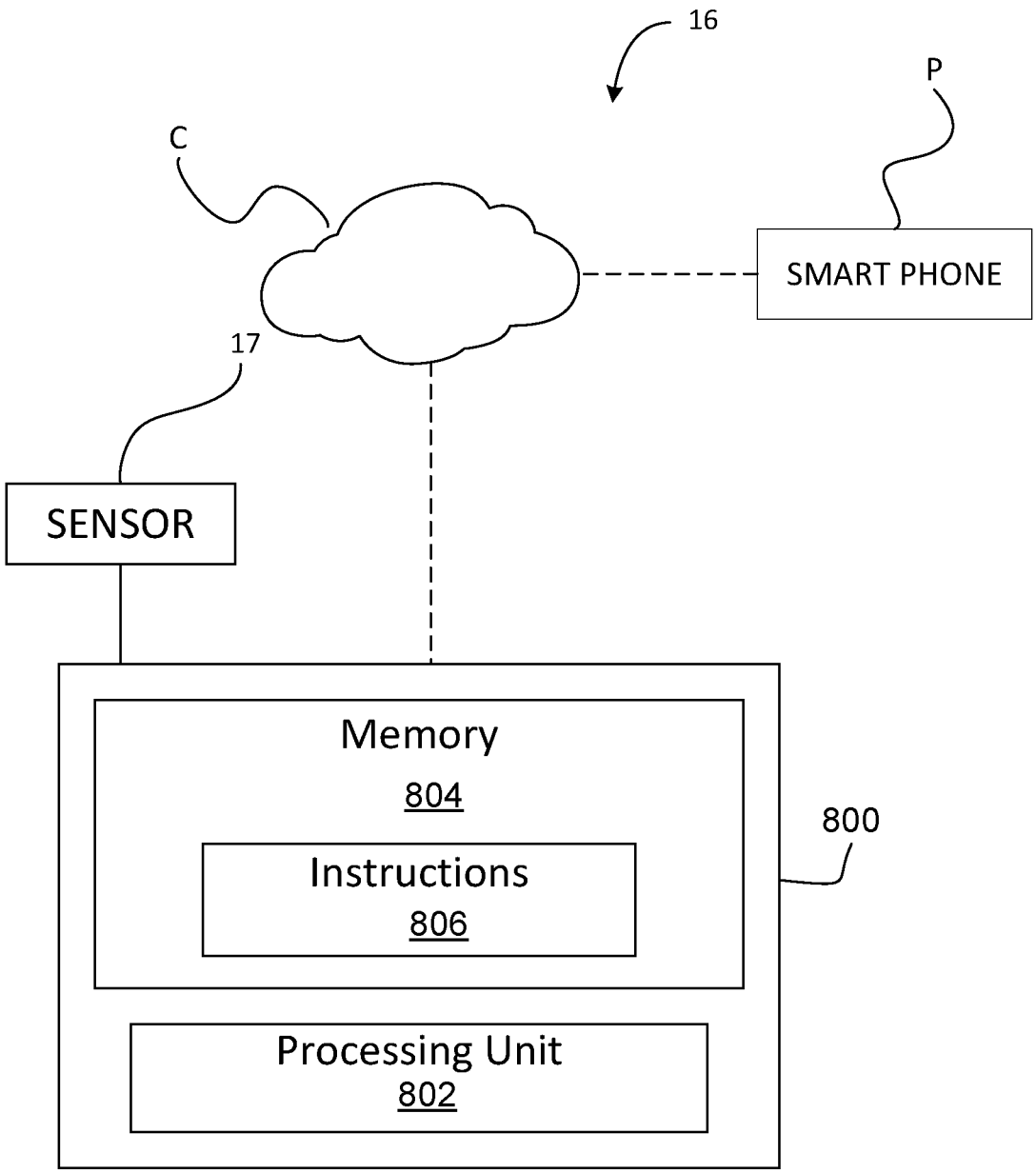
FIG. 8 is an exemplary view of a controller in accordance with one embodiment.

Referring now to FIG. 8, the controller 16 is described in more detail. The controller 16 is operatively connected to the sensor 17 and includes a computing device 800. For simplicity only one computing device 800 is shown but the system may include more computing devices 800 operable to exchange data. The computing devices 800 may be the same or different types of devices. The controller 16 may be implemented with one or more computing devices 800.

The computing device 800 comprises a processing unit 802 and a memory 804 which has stored therein computer-executable instructions 806. The processing unit 802 may comprise any suitable devices configured to implement the method 700 such that instructions 806, when executed by the computing device 800 or other programmable apparatus, may cause the functions/acts/steps performed as part of the method 700 as described herein to be executed. The processing unit 802 may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory 804 may comprise any suitable known or other machine-readable storage medium. The memory 804 may comprise non-transitory computer readable storage medium, for example, but not limited to, an electronic, magnetic, optical, electromagnetic, infrared, or semiconductor system, apparatus, or device, or any suitable combination of the foregoing. The memory 804 may include a suitable combination of any type of computer memory that is located either internally or externally to device, for example random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. Memory 804 may comprise any storage means (e.g., devices) suitable for retrievably storing machine-readable instructions 806 executable by processing unit 802.

The methods and systems for dispensing a beverage described herein may be implemented in a high level procedural or object oriented programming or scripting language, or a combination thereof, to communicate with or assist in the operation of a computer system, for example the computing device 800. Alternatively, the methods and systems for dispensing a beverage may be implemented in assembly or machine language. The language may be a compiled or interpreted language. Program code for implementing the methods and systems for dispensing a beverage may be stored on a storage media or a device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein. Embodiments of the methods and systems for dispensing a beverage may also be considered to be implemented by way of a non-transitory computer-readable storage medium having a computer program stored thereon. The computer program may comprise computer-readable instructions which cause a computer, or more specifically the processing unit 802 of the computing device 800, to operate in a specific and predefined manner to perform the functions described herein, for example those described in the method 700.

Computer-executable instructions may be in many forms, including program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

The embodiments described herein are implemented by physical computer hardware, including computing devices, servers, receivers, transmitters, processors, memory, displays, and networks. The embodiments described herein provide useful physical machines and particularly configured computer hardware arrangements. The embodiments described herein are directed to electronic machines and methods implemented by electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, and various hardware components. Substituting the physical hardware particularly configured to implement various acts for non-physical hardware, using mental steps for example, may substantially affect the way the embodiments work. Such computer hardware limitations are clearly essential elements of the embodiments described herein, and they cannot be omitted or substituted for mental means without having a material effect on the operation and structure of the embodiments described herein. The computer hardware is essential to implement the various embodiments described herein and is not merely used to perform steps expeditiously and in an efficient manner.

The term "connected" or "coupled to" may include both direct coupling (in which two elements that are coupled to each other contact each other) and indirect coupling (in which at least one additional element is located between the two elements).

The technical solution of embodiments may be in the form of a software product. The software product may be stored in a non-volatile or non-transitory storage medium, which can be a compact disk read-only memory (CD-ROM), a USB flash disk, or a removable hard disk. The software product includes a number of instructions that enable a computer device (personal computer, server, or network device) to execute the methods provided by the embodiments.

As can be seen therefore, the examples described above and illustrated are intended to be exemplary only. The scope is indicated by the appended claims.

What is claimed is:

1. A beverage dispensing system, comprising:

a reservoir containing a beverage;

a line connected to the reservoir;

a tap connected to the line for pouring the beverage;

a first valve connected to the line downstream of the reservoir relative to a flow of the beverage in the line, the first valve having a first open configuration and a first closed configuration; and a second valve connected to the line downstream of the first valve and at or proximate a tap outlet of the tap, the second valve having a second open configuration and a second closed configuration, the second valve being in the second closed configuration when the first valve is in the first closed configuration, the second valve including a valve housing defining a passage for the beverage, a valve member movable relative to the valve housing from a first position in which the valve member obstructs the passage to a second position in which the valve member is offset from the passage, and a biasing member biasing the valve member in the first position, the biasing member being a magnet secured to one of the valve member and the valve housing and magnetically attracting the other of the valve member and the valve housing to magnetically force the valve member in the first position;

when in the second closed configuration, the second valve blocking fluid communication between the tap outlet and the first valve such that a portion of the line between the first valve and the second valve is isolated from the tap outlet, the second valve being in the second open configuration when the first valve is in the first open configuration to connect the reservoir to the tap outlet through the first valve and the second valve.

2. The beverage dispensing system of claim 1, wherein the second valve is a passive valve moving from the second closed configuration to the second open configuration following a pressure differential across the second valve greater than a pressure threshold.

3. The beverage dispensing system of claim 2, wherein the pressure threshold corresponds to a beverage pressure inside the line upstream of the first valve.

4. The beverage dispensing system of claim 1, wherein the magnet is secured to the valve housing and magnetically attracts the valve member.

5. The beverage dispensing system of claim 1, wherein a force of the magnet is selected such that the valve member moves from the first position the second position when the valve member is subjected to a beverage pressure when the first valve is in the first open configuration.

6. The beverage dispensing system of claim 1, wherein the valve housing includes a main body and a valve seat secured to the main body, the valve member in abutment against the valve seat in the first position, the valve seat being the magnet.

7. The beverage dispensing system of claim 1, wherein the first valve is an actuated valve engaged by an actuator.

8. The beverage dispensing system of claim 7, wherein the actuator is a solenoid.

9. The beverage dispensing system of claim 7, comprising a controller having a processing unit and a computer-readable medium operatively connected to the processing unit and having instructions stored thereon executable by the processing unit for:

receiving a signal indicative of a beverage request from a user; and opening the first valve by actuating the actuator thereby exposing the second valve to a beverage pressure being above a retention pressure of the second valve.

10. The beverage dispensing system of claim 9, wherein the receiving of the signal includes receiving a signal from a smart phone of a user.

11. The beverage dispensing system of claim 10, wherein the receiving of the signal from the smart phone includes receiving the signal from the smart phone via a cloud.

12. A beverage dispensing system, comprising:

a reservoir containing a beverage;

a line connected to the reservoir;

a tap connected to the line for pouring the beverage;

a first valve connected to the line downstream of the reservoir relative to a flow of the beverage in the line, the first valve having a first open configuration and a first closed configuration; and a second valve connected to the line downstream of the first valve and at or proximate a tap outlet of the tap, the second valve having a second open configuration and a second closed configuration, the second valve being in the second closed configuration when the first valve is in the first closed configuration, the second valve including a valve housing defining a passage for the beverage, a valve member movable relative to the valve housing from a first position in which the valve member obstructs the passage to a second position in which the valve member is offset from the passage, and a biasing member biasing the valve member in the first position, the valve member being a ball movable within the valve housing.

13. The beverage dispensing system of claim 12, wherein the second valve is a passive valve moving from the second closed configuration to the second open configuration following a pressure differential across the second valve greater than a pressure threshold.

14. The beverage dispensing system of claim 12, wherein the first valve is an actuated valve engaged by an actuator.

15. The beverage dispensing system of claim 14, wherein the actuator is a solenoid.

16. The beverage dispensing system of claim 14, comprising a controller having a processing unit and a computer-readable medium operatively connected to the processing unit and having instructions stored thereon executable by the processing unit for:

receiving a signal indicative of a beverage request from a user; and opening the first valve by actuating the actuator thereby exposing the second valve to a beverage pressure being above a retention pressure of the second valve.

17. A beverage dispensing system, comprising:

a reservoir containing a beverage;

a line connected to the reservoir;

a tap connected to the line for pouring the beverage;

a first valve connected to the line downstream of the reservoir relative to a flow of the beverage in the line, the first valve having a first open configuration and a first closed configuration; and a second valve connected to the line downstream of the first valve and at or proximate a tap outlet of the tap, the second valve having a second open configuration and a second closed configuration, the second valve being in the second closed configuration when the first valve is in the first closed configuration, the second valve including a valve housing defining a passage for the beverage, a valve member movable relative to the valve housing from a first position in which the valve member obstructs the passage to a second position in which the valve member is offset from the passage, and a biasing member biasing the valve member in the first position, the valve member being a gate pivotably connected to the valve housing and pivotable between the first position and the second position, the biasing member being a spring engaged to the gate.

18. The beverage dispensing system of claim 17, wherein the second valve is a passive valve moving from the second closed configuration to the second open configuration following a pressure differential across the second valve greater than a pressure threshold.

19. The beverage dispensing system of claim 17, wherein the first valve is an actuated valve engaged by an actuator.

20. The beverage dispensing system of claim 19, comprising a controller having a processing unit and a computer-readable medium operatively connected to the processing unit and having instructions stored thereon executable by the processing unit for:

receiving a signal indicative of a beverage request from a user; and opening the first valve by actuating the actuator thereby exposing the second valve to a beverage pressure being above a retention pressure of the second valve.

* * * * *